US006739580B2

(12) United States Patent
Gordon

(10) Patent No.: US 6,739,580 B2
(45) Date of Patent: May 25, 2004

(54) ELECTRICALLY OPERABLE VEHICLE JACKS

(76) Inventor: Herman Gordon, 1315 Wright Dr., Huntingdon Valley, PA (US) 19006

( * ) Notice: Subject to any disclaimer, the term of this patent is extended or adjusted under 35 U.S.C. 154(b) by 0 days.

(21) Appl. No.: 10/079,171

(22) Filed: Feb. 20, 2002

(65) Prior Publication Data

US 2002/0162992 A1 Nov. 7, 2002

Related U.S. Application Data

(60) Provisional application No. 60/269,228, filed on Feb. 20, 2001.

(51) Int. Cl.[7] ..... B66F 3/22

(52) U.S. Cl. ..... 254/126; 254/122; 254/103; 254/DIG. 2

(58) Field of Search ..... 254/126, 122, 254/425, 424, 98, 103, 1, DIG. 2

(56) References Cited

U.S. PATENT DOCUMENTS 2,047,484 A * 7/1936 McBrady ..... 254/126
4,653,727 A 3/1987 Chang et al.
4,749,169 A 6/1988 Pickles
4,872,230 A 10/1989 Levine
5,085,407 A 2/1992 Lonon
5,876,526 A 3/1999 Hamade et al.

* cited by examiner

*Primary Examiner*—Robert C. Watson
(74) *Attorney, Agent, or Firm*—Synnestvedt & Lechner LLP

(57) ABSTRACT

A lightweight, portable jack for a wheeled vehicle is provided. The jack includes a high-torque electric motor adapted to use the electric power supply from the vehicle through electrical connectors connectable to the terminals of the vehicle battery or through use of an electrical connector which may be plugged in to the cigarette lighter receptacle. The jack is fully movable from a recessed position within a low profile casing and is operated by a remote control device so that it can lift the wheel of a vehicle from an operator position well out of the path of traffic or, if desired, from inside the vehicle. The jack disclosed is of lightweight construction so that it can be removed from storage and positioned by practically any vehicle operator.

9 Claims, 4 Drawing Sheets

ELECTRICALLY OPERABLE VEHICLE JACKS

RELATED APPLICATION

This application is based on and claims priority to U.S. Provisional Application No. 60/269,228, filed Feb. 20, 2001.

FIELD OF THE INVENTION

This invention relates to vehicle jacks and more particularly to a portable vehicle jack capable of being remotely operated and powered by the electrical system of the vehicle.

BACKGROUND OF THE INVENTION

The need has long existed for an improved portable jack for automotive vehicles. It is highly desirable that a jack become available that can be operated alternatively from inside the vehicle or from a location of safety off the road on which the vehicle is located. Such a jack should desirably be light enough and be compact enough so that it can be stored in an automobile trunk, can be lifted up and carried by most adults to its position of use, and yet be capable of lifting a wheel of a 4,000–5,000 pound vehicle off the ground. Further, it should be stable and easily controllable by a remote control device so that jacking can be done from a position of safety. Desirably, it should be illuminated so that it can be easily positioned and operated after dark and will signal to passersby that the vehicle is disabled. It should be easily movable either to a position underneath the axle of the vehicle or some other reinforced support surface designed to be engaged by a jack. The invention disclosed in what follows satisfies these needs to a remarkable degree.

BRIEF DESCRIPTION OF THE DRAWINGS

With reference to the foregoing, the drawings which follow illustrate a presently preferred embodiment of the invention.

DETAILED DESCRIPTION OF THE PREFERRED EMBODIMENT

Figure 1:
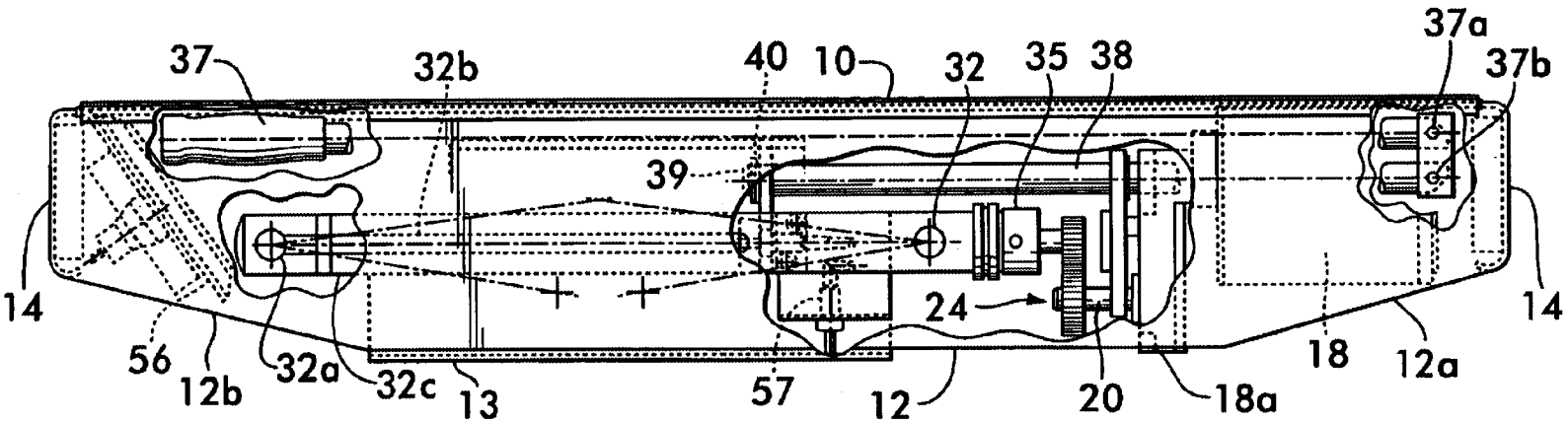
FIG. 1 is a side view of the jack with certain portions eliminated for the purposes of illustration.
Figure 2:
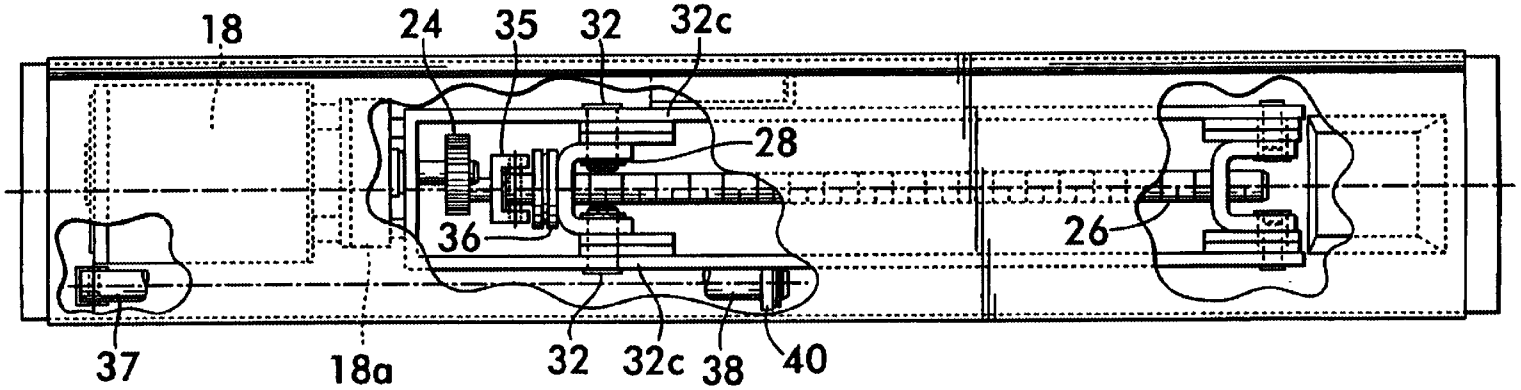
FIG. 2 is a plan view of the jack of FIG. 1.
Figure 4:
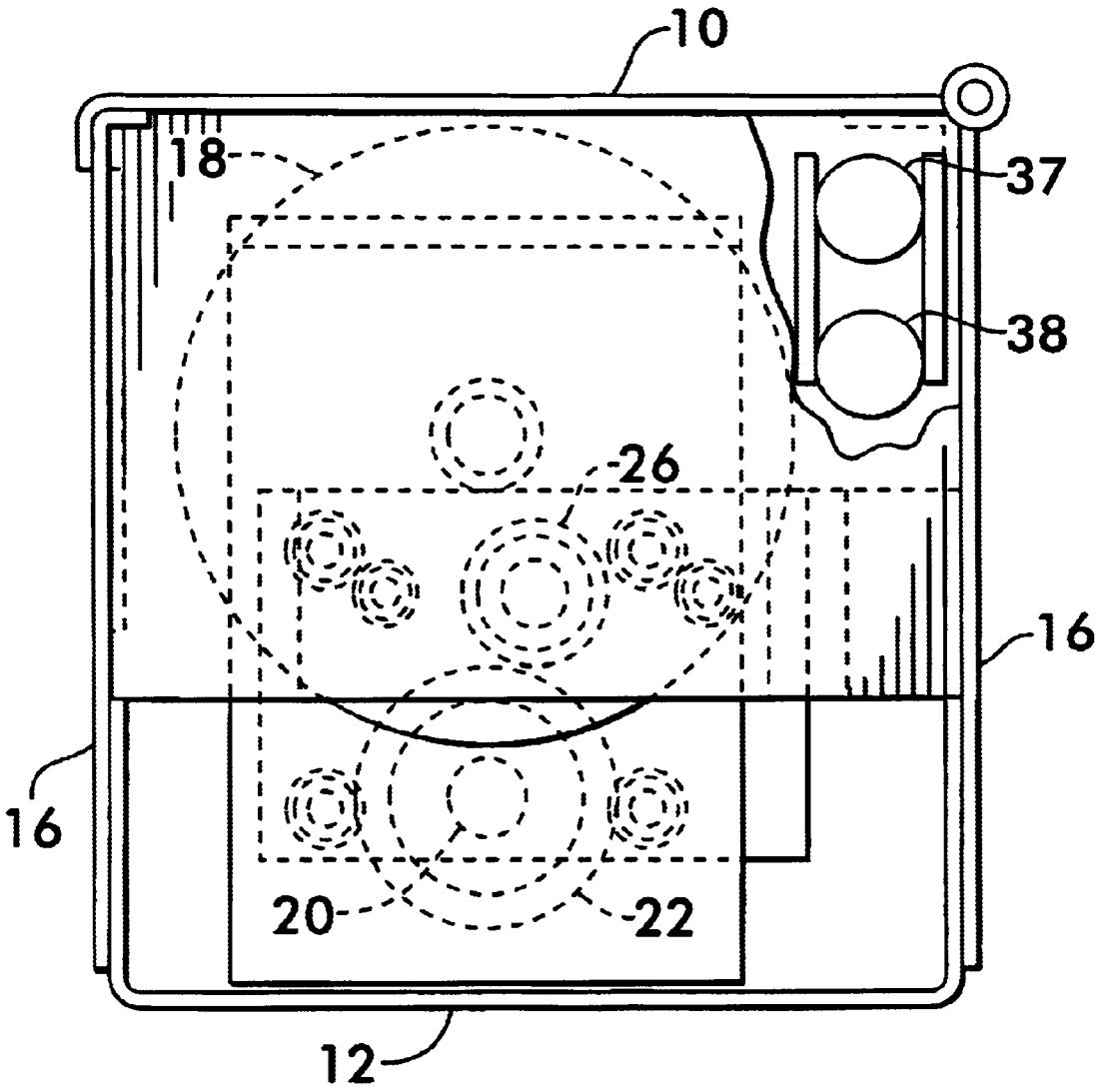
FIG. 4 is a end view of the jack of FIGS. 1 and 2.

As illustrated in FIGS. 1, 2 and 4, a jack formed according to the invention is mounted securely within an elongated metallic case having a low profile, a hinged top 10, a supporting base 12 having inclined portions 12*a* and 12*b*, end walls 14 and side walls 16. The case is suitably dimensioned to fit under all conventional automotive-type vehicles. The base may be provided with skids 13. The skids and the inclined end walls facilitate sliding movement over rough and irregular surfaces such as might be encountered on the shoulder of the road. The case houses a 12V DC high-torque motor 18 affixed by any suitable means within one end thereof. Motor 18, as best seen in FIGS. 1 and 2, has an eccentrically mounted shaft 20 and internally housed reduction gearing schematically represented by gear box 18*a*. External reduction gearing, generally shown at 24, may also be employed to increase the gear ratio. The gearing drives a lead screw 26 (FIG. 2) which extends lengthwise of the case. A preferred motor for the purpose, manufactured by Ametek Specialty Motors of Hudson, Wis., has an integrally connected gear box with a 96:1 gear ratio and is identified by the number SB3743.

Figure 3:
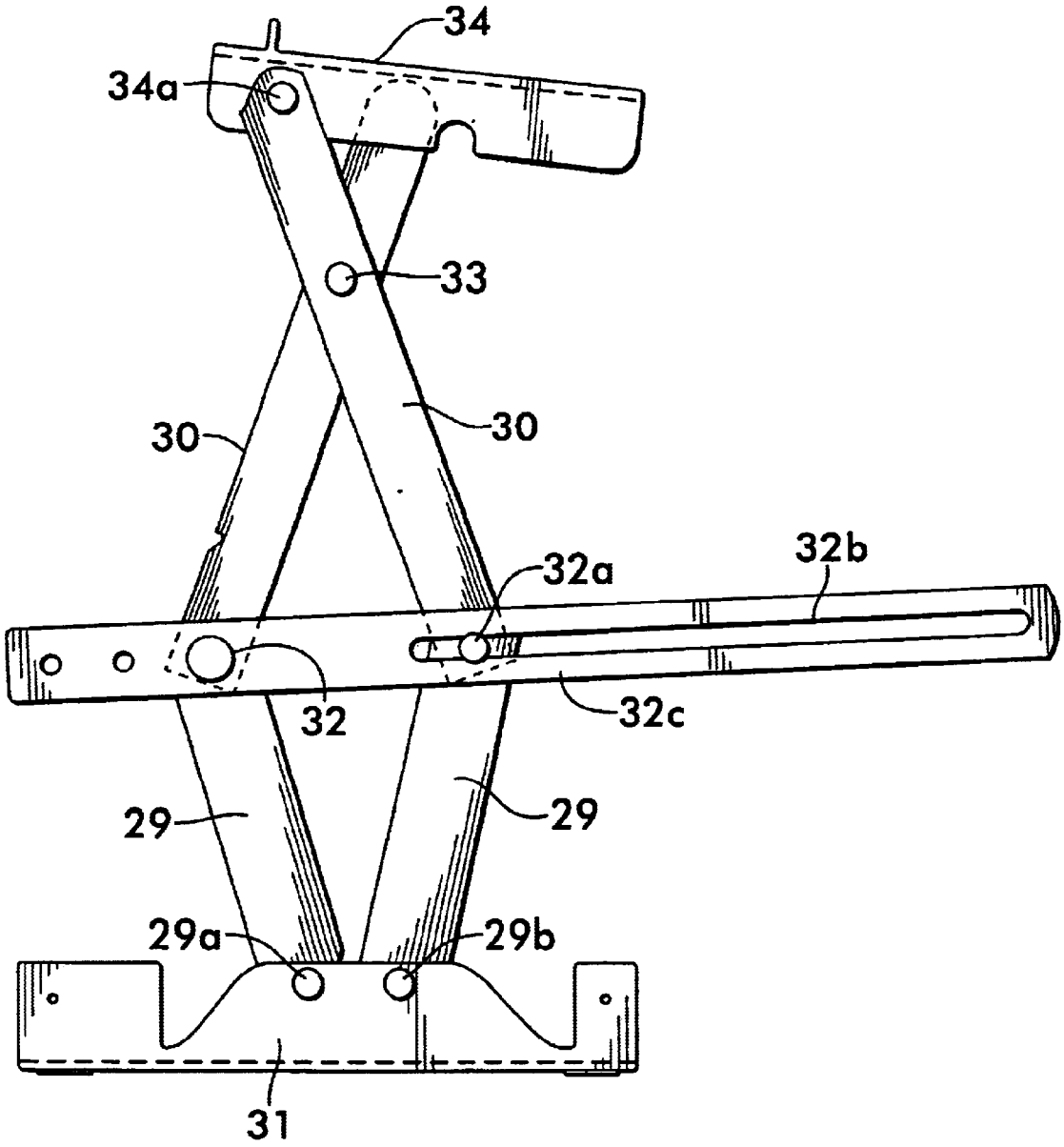
FIG. 3 is a view of a preferred form of jacking mechanism removed from the case illustrated in FIGS. 1 and 2.

The jacking mechanism is best shown in FIG. 3 in which the jack is shown in the extended position. The preferred form of jacking mechanism preferably comprises pairs of spaced apart, parallelogram linkages, only one pair of which can be seen in FIG. 3. Each linkage comprises arms 29 and 30. The arms 29 are pivotally mounted on a base plate 31 by pins 29*a* and 29*b*. The arms 29 are pivotally joined to upper arms 30 by pins 32 and 32*a*, the pins joining one of the pairs of arms riding in a slot 32*b* in stabilizing arm member 32*c* which is, in turn, affixed to motor 18 as shown in FIG. 2. The upper arms 30 cross one another and are pivotally joined by pin 33. A plate 34 for engaging a vehicle axle or other vehicle jack location intended for support of the vehicle on the jack is pivotally mounted on one of the arms 30 of each linkage by means such as pivot pin 34*a*. The opposite arm 30 of each linkage provides support for the plate 34, the end of the arm 30 of each linkage being slidable relatively to the under surface of the plate as the jack moves between its retracted position in which it is retracted into the casing and an elevated position in which the selected vehicle wheel is clear of the support surface. A U-shaped coupling member 28 (FIG. 2) is pivotally mounted on pins 32. The jack is raised and lowered by means of a coupling member 35 which carries a threaded nut 36 (FIGS. 2 and 5) which is threaded onto lead screw 26. Upon rotation of the lead screw 26 by motor 18, the nut 36 travels along the lead screw 26 moving the arms 29 and 30 of each linkage toward and away from each other to raise and lower the jack.

Also mounted in the casing is a handle 37 shown in broken lines in FIG. 1. The handle is preferably broken into two parts, joined by pins 37*a* and 37*b* and a connecting piece 38. The piece 38 has an end 39 fixed to a bracket 40 attached to the case. The handle 34 is pivotally movable so that its free end is movable out of the case and extends away from casing end 14 and serves as a means for positioning the jack underneath the vehicle.

Figure 5:
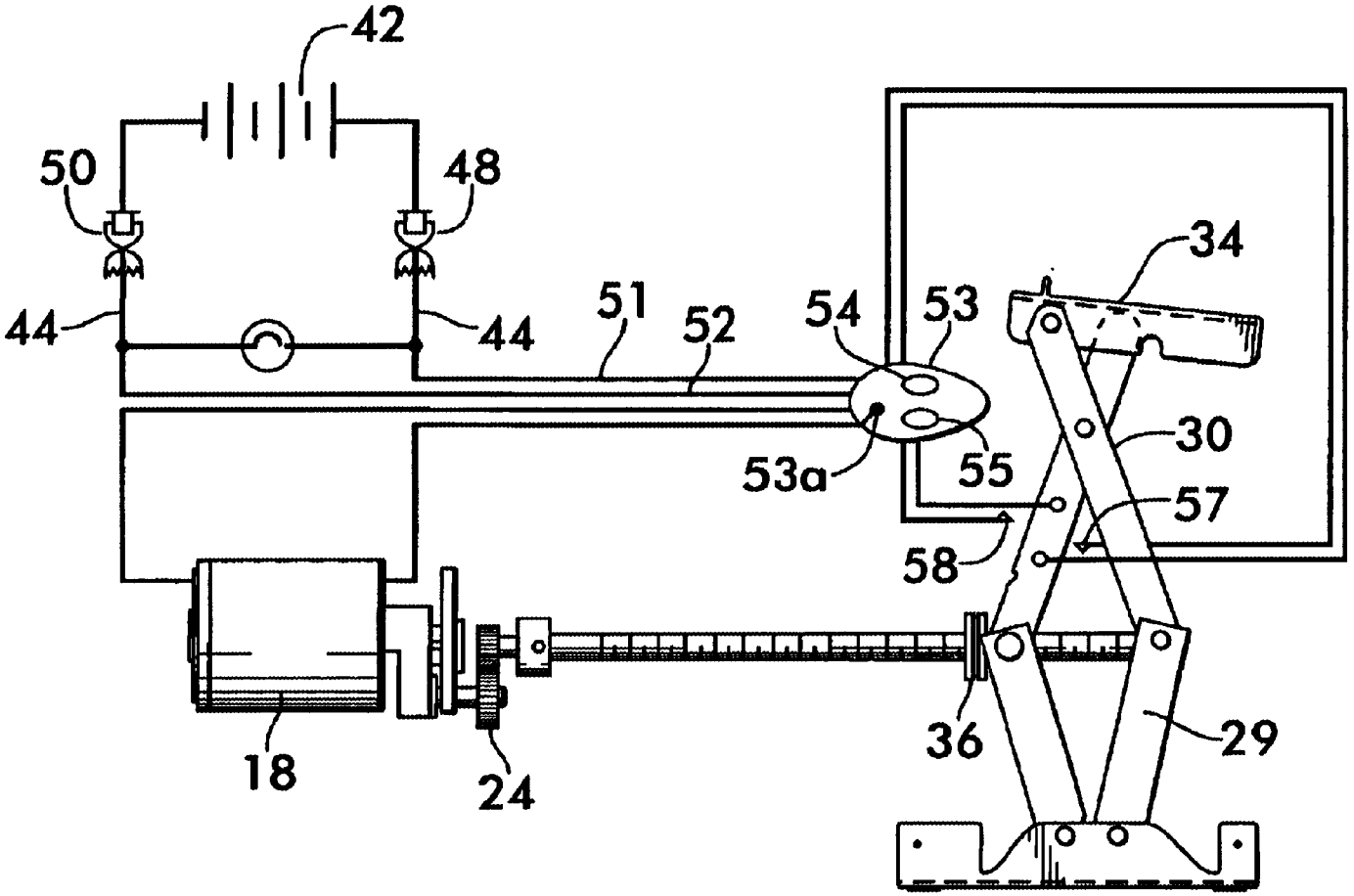
FIG. 5 is a schematic view illustrating the control circuit used in controlling the jack of FIGS. 1–4.

With reference to FIG. 5, the vehicle battery is shown schematically at 42. Preferably, the jack is provided with a pair of elongated, flexible connecting cables 44 which are connectable to the vehicle electrical system by means such as electrically-conducting, spring-loaded clamps 48 and 50 which electrically connect to the terminal posts of the battery. Alternatively, the connection means may be a plug-in connector which fits into the cigarette lighter receptacle of the vehicle and thereby provides a more convenient connection to the electrical system. The plug-in connector used is entirely conventional, and the circuit is otherwise identical to that illustrated in FIG. 5.

A hand-held, portable remote control device 53 is connected to the motor circuit by flexible cables 51, 52. The control device is provided with an off/on switch 53*a*, a first control switch 54 for energizing the motor to raise the jack and a second control switch 55 for reversing the motor and thereby lowering the jack. The power cord of the remote control device should be long enough to allow for remote control of the jack at a location either within the vehicle or spaced at the side of the road safely away from the flow of traffic. The circuit further comprises a lamp 56 which is preferably inclined upwardly as shown in FIG. 1 so as to illuminate the underside of the vehicle to facilitate proper positioning of the jack. The lamp is preferably constantly on when the circuit is connected to the vehicle battery and serves as a warning to passing traffic that the vehicle is disabled. The circuit preferably comprises limit switches 57 and 58 mounted within the jack casing and opened by projections from arms 29 or 30 at the limits of their travel. Opening of either limit switch interrupts the motor circuit to stop the motor 18 when the jack is in the lower or upper limit position, respectively.

In the lowered position, all parts, including connecting cables and controller 52, fit snuggly within the casing. The casing lid is preferably hingedly connected to the body, as shown in FIG. 4, and secured in place by releasable latches, not shown. A handle, centered at the center of gravity of the case, is also preferably attached to the lid. A jack, with casing included, constructed as described above has an overall weight of about 25 pounds so that it can easily be carried by the motorist. The jack mechanism fits within a casing whose overall dimensions are 5 inches by 5 inches by 25 inches so that it can easily be stowed within the vehicle when not in use. The jack has been proven in testing to quickly and easily lift a wheel of a 5,000 pound sport utility vehicle off the ground.

What is claimed is:

1. A portable jack for a wheeled vehicle having jack locations interfitting with the jack for elevation of a selected portion of the vehicle by elevation of the jack, wherein said jack comprises:

a low-profile casing dimensioned to fit on a support surface at a selected jack location of a vehicle, said casing being elongated and comprising side and end walls and a base, said side and end walls being vertically dimensioned to fit within the space underneath the vehicle;

a high-torque electric motor recessed within said casing adjacent an end thereof, said motor having electrical connector means for connection to the electrical system of the vehicle and a remote control device for remotely controlling the motor at a position spaced away from the vehicle; and a jack mechanism within said casing, said jack mechanism comprising a first pair of toggle members each having first end portions pivotally supported on said base and second end portions, a second pair of toggle members having first end portions each having a pivotal connection to one of the second end portions of said first toggle members, said second pair of toggle members being disposed in crossing relationship at an intermediate position of each toggle of the pair having a pivotal interconnection at said intermediate position, and an elongated jacking platform for support of the vehicle at a selected one of said jacking locations, one of said second pair of toggle members having a second end portion having pivotal interconnection to said jacking platform, the second end portion of the other toggle member of the second pair slidably supporting the elongated jacking platform, said jack mechanism further comprising an elongated threaded shaft rotatably driven by said motor, a threaded drive nut having threads interfitting with the threads on said shaft, said drive nut being connected to a first one of said first pair of toggle members for affecting relative movement of said toggle members toward one another from a position in which the jack is recessed within the casing to an elevated position sufficient to effect clearance of a selected vehicle wheel above a support surface, said motor being reversibly operable by said remote control device to affect relative movement of said drive shaft and said toggle members away from one another to lower said support platform to the recessed position within said low-profile casing and a stabilizing member supporting said motor and supported by said base.

2. A portable jack according to claim 1, further including a positioning handle for positioning said jack in selected positions beneath the vehicle, said positioning handle having a first elongated portion having a first end pivotally connected to the casing at a point within the casing adjacent one of the casing ends, said first elongated portion having a second end, said handle having a second elongated portion having a first end pivotally connected to the second end of the first elongated portion, said handle portions being foldable through about 180° from a position in which both portions fit within the casing in side-by-side relationship to a position in which both portions are in axial alignment and the second elongated portion extends beyond the casing, said handle thereby allowing for placement of said jack beneath the vehicle and for removal therefrom by a person standing remote from the vehicle.

3. A portable jack according to claim 1, wherein said stabilizing member extends lengthwise of said toggle members, said stabilizing member having an elongated slot, said slot receiving said pivotal connection of one of said toggle members of each of said pair of toggle members, the pivotal connection of the other toggle member of each said pair of toggle members being fixed to said stabilizing member and being relatively rotatable with respect thereto, said stabilizing member restrains lateral movement of said toggle members and allows for relative motion of said pivotal connection lengthwise of the slot upon operation of said motor.

4. A portable jack according to claim 2, wherein said motor is a 12 volt motor having reduction gearing providing a gear ratio of at least about 90:1.

5. A portable jack according to claim 4, wherein said gear ratio is 96:1.

6. A portable jack according to claim 5, wherein said connector means includes a power connector connectable to the cigarette lighter of the vehicle.

7. A portable jack according to claim 2, wherein said connector means includes a power connector connectable to the terminals of the battery of the vehicle.

8. A portable jack according to claim 7, further including a light within said casing for lighting the underside of the vehicle.

9. A portable jack according to claim 8, wherein said remote control device includes a power cord having a length allowing for control of the motor from locations remote from the vehicle.

* * * * *